US005216852A

United States Patent [19]

Bemis et al.

[11] Patent Number: 5,216,852

[45] Date of Patent: Jun. 8, 1993

[54] HINGED RAIN GUTTER

[75] Inventors: Peter F. Bemis, Sheboygan; Bradley J. Bruggink, Oostburg; Daniel N. Cykana; Dale E. Schmidt, both of Sheboygan, all of Wis.

[73] Assignee: Bemis Manufacturing Company, Sheboygan Falls, Wis.

[21] Appl. No.: 610,522

[22] Filed: Nov. 8, 1990

[51] Int. Cl.[5] ..... E04D 13/06

[52] U.S. Cl. ..... 52/12; 52/11; 248/48.1

[58] Field of Search ..... 52/11, 12, 15, 16; 248/48.1, 48.2; 285/226

[56] References Cited

U.S. PATENT DOCUMENTS

| | | | |
|---|---|---|---|
| 1,442,625 | 1/1923 | Lyth | 285/226 |
| 2,988,226 | 6/1961 | Campbell | 52/12 |
| 3,252,288 | 5/1966 | Tennison, Jr. . | |
| 3,545,144 | 12/1970 | Sickler | 248/48.2 |
| 3,550,381 | 12/1970 | South . | |
| 3,611,731 | 10/1971 | Edmondson | 52/11 |
| 3,670,505 | 6/1972 | Weaver | 52/11 |
| 3,913,284 | 10/1975 | Hall . | |
| 4,150,515 | 4/1979 | Giulini . | |
| 4,257,716 | 3/1981 | Woodrow . | |
| 4,309,792 | 1/1982 | Faye . | |
| 4,313,693 | 2/1982 | Follows et al. | 52/11 |
| 4,446,658 | 5/1984 | Gouin | 52/11 |
| 4,632,342 | 12/1986 | Skinner | 52/11 |
| 4,646,487 | 3/1987 | Andersson | 52/11 |
| 4,727,689 | 3/1988 | Bosler | 52/12 |
| 4,858,396 | 8/1989 | Rose et al. | 52/11 |
| 4,912,888 | 4/1990 | Martin | 52/11 |
| 4,954,015 | 9/1990 | McGowan | 52/11 |

FOREIGN PATENT DOCUMENTS

| | | |
|---|---|---|
| 717700 | 9/1965 | Canada . |

*Primary Examiner*—Michael Safavi
*Attorney, Agent, or Firm*—Michael, Best & Friedrich

[57] ABSTRACT

A rain gutter assembly including an elongated trough-like rain gutter having a rear wall, a trough and a leaf guard integrally connected by a pair of living hinges, grommets adapted to house a fastener for supporting the rain gutter, and a connector for sealingly connecting a pair of closely-spaced, aligned rain gutters.

19 Claims, 3 Drawing Sheets

HINGED RAIN GUTTER

BACKGROUND OF THE INVENTION

1. Technical Field

The invention relates to gutters for collecting water, and specifically to hinged rain gutter assemblies 2. Description of the Related Art In order to protect the side of a building and other objects from water damage caused by rain water falling from the roof of the building, rain gutter assemblies are typically provided to collect the falling water and to channel the collected water to a downspout. Typically, rain gutter assemblies include abutting troughs which are supported by the wall of the building adjacent the roof.

It is generally known to construct rain gutters by extruding plastic, for example polyvinyl chloride, to form the trough of a rain gutter. As a material for rain gutters, plastic provides several advantages. Plastic rain gutters are characteristically durable and relatively lightweight, which makes plastic rain gutters easier to handle and install than rain gutters made of galvanized steel or copper, for example. The use of plastic as a material for rain gutters also introduces several considerations which must be addressed for a successful rain gutter design. Because plastic can have a relatively high coefficient of expansion, and because rain gutter assemblies are typically subject to variable temperature environments, plastic rain gutters are generally not dimensionally stable. The expansion and contraction of plastic rain gutters caused by varying temperatures must be considered in the support of the rain gutter assembly on the side of a building and in the connection of abutting sections of rain gutters.

SUMMARY OF THE INVENTION

The invention provides a rain gutter assembly which is well-suited to collect water from the roof of a building. The rain gutter assembly includes an elongated rain gutter which has a trough-like cross-sectional configuration to collect and channel water falling from the roof. Preferably, the rain gutter is made of extruded plastic. The rain gutter has a rear wall which is mounted on the side of a building, a trough portion which, together with the rear wall, forms the trough-like configuration, and a leaf guard which extends over the trough to prevent leaves and other objects which might obstruct the trough from falling into the trough.

The rear wall and the trough portion are preferably integrally joined by a hinge which extends substantially the entire length of the rain gutter. Similarly, the leaf guard and the trough portion are preferably integrally joined by a second hinge which extends substantially the entire length of the rain gutter. Preferably, the first and second hinges are living or integral hinges. Provision of living hinges connecting the rear wall to the trough portion and connecting the trough portion to the leaf guard allows the manufacture of a length of rain gutter as a single piece by extrusion of plastic. The living hinges also allow the rain gutter to be laid open in a substantially flat position so that rain gutters can be easily stacked for storage and handling. The provision of an integrally formed hinge also provides a rain gutter which is relatively simple to assemble and mount on a building.

The rain gutter assembly also includes mounting means for supporting the rain gutter on the building.

The mounting means accommodates the expansion and contraction of the plastic rain gutter due to varying temperatures, and further protects the plastic rain gutter, which is relatively soft, from damage during installation of the rain gutter assembly. More specifically, the mounting means includes a plurality of grommets which extend through an elongated slot in the rear wall of the rain gutter. Preferably, each grommet has a first portion which is cup-shaped and which engages the inner surface of the rear wall, and a second portion which extends from the base of the cup portion and into the slot. The grommet has a bore therethrough adapted to house a fastener, such as a nail. The cup-shaped portion of the grommet protects the rear wall from damage during installation, for example, by absorbing the blow of a hammer against the nail. Also, because the slot houses the grommet and the fastener, the rain gutter can move by contraction and expansion relative to the grommet and fastener.

The rain gutter assembly also includes connecting means for joining closely-spaced, aligned lengths of rain gutter to channel collected rain water from one rain gutter to an adjacent rain gutter. The connecting means sealingly joins adjacent rain gutters, yet provides for relative movement between the rain gutters due to expansion and contraction. In one embodiment, the connecting means includes an adhesive foam gasket which is squeezed against the outer surface of the closely spaced, aligned rain gutters by a clip member which wraps around the aligned rain gutters. In an alternative embodiment, the connecting means includes an expansion connection which extends between closely spaced, aligned rain gutters and which is adhesively fastened to the interior surface of the rain gutters.

Other features and advantages of the invention will become known by reference to the following detailed description, claims and the appended drawings.

BRIEF DESCRIPTION OF THE DRAWINGS

FIG. 8 is an a front view of a grommet for use in the rain gutter assembly shown in FIG. 1.

FIG. 9 is a cross-sectional view of the grommet shown in FIG. 8, taken along line 9—9.

Figures 1, 2, 3:
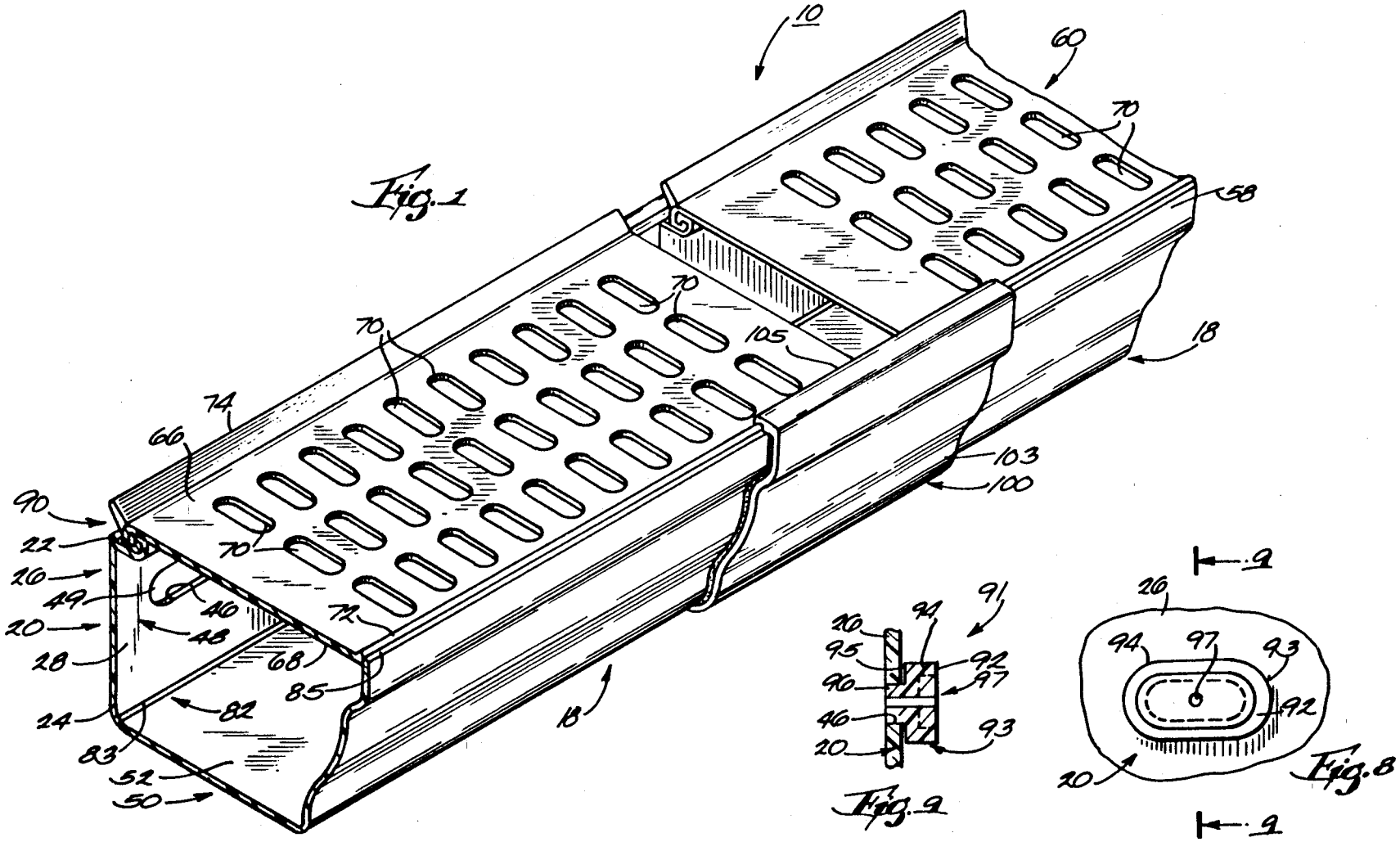
FIG. 1 is a perspective view of a rain gutter assembly embodying various features of the invention.
FIG. 2 is a cross-sectional view of the assembly illustrated in FIG. 1 and mounted on the side of a building.
FIG. 3 is an end view of a portion of the rain gutter illustrated in FIG. 1 in a laid-open position.
Figure 2:
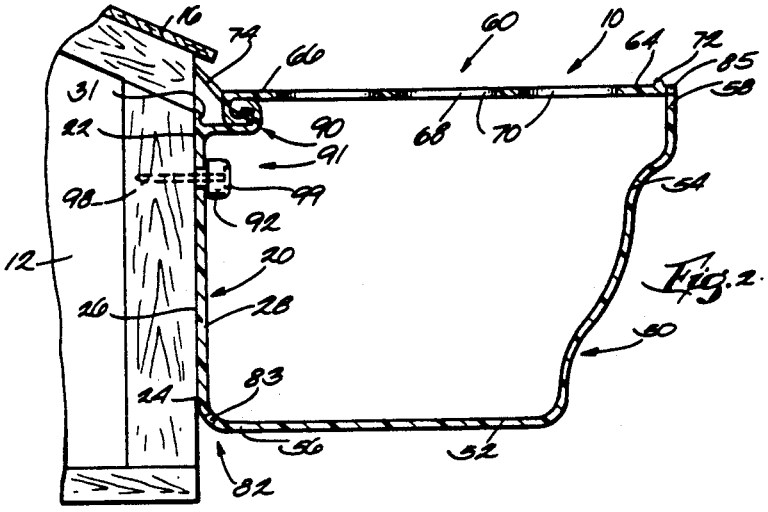
Figure 3:
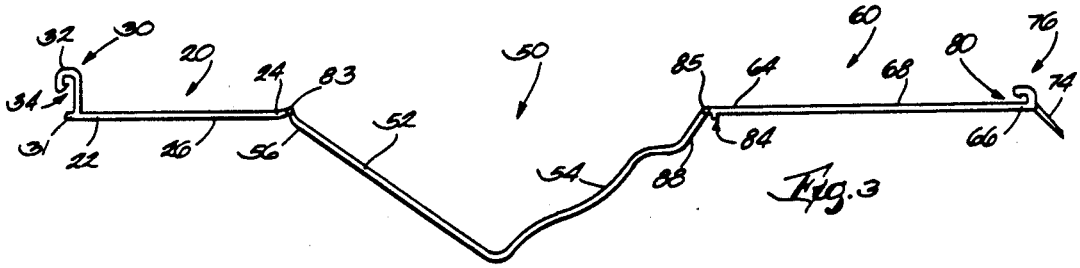

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and the terminology used herein is for the purpose of description and should not be regarded as limiting.

DETAILED DESCRIPTION OF THE PREFERRED EMBODIMENT

A rain gutter assembly 10 embodying various features of the invention is illustrated in the drawings. As shown in FIG. 2, the rain gutter assembly 10 can be mounted on the side of a building 12 below a sloped roof 16 so as to collect water falling from the roof 16 of the building 12.

As best shown in FIG. 1, the rain gutter assembly 10 includes at least a pair of elongated, mutually aligned rain gutters 18. The rain gutters 18 each have an inner surface 19 which provides a trough-like cross-sectional configuration in a plane generally perpendicular to the length of the gutter 18 to collect falling water and to channel collected water to a downspout (not shown). Each rain gutter 18 includes a generally vertically disposed rear wall 20 having an upper edge 22 and a lower edge 24. The rear wall 20 (see FIG. 2) has an outer, generally planar mounting surface 26 which extends between the upper and lower edges 22, 24 and which faces the side of the building 12, and an inner surface 28 which faces away from the the building 12. As shown in FIG. 2, the rear wall 20 has a generally uniform thickness between the inner and outer surfaces 28, 26. A first clasp member 30 extends horizontally from the inner surface 28 of the rear wall 20 adjacent the upper edge 22 and away from the building 12 so that the upper edge 22 forms a vertically disposed upper lip 31. The first clasp member 30 includes an upwardly curled end 32 which turns 180° toward the building 12 so that the first clasp member 30 forms a hook 34 which opens toward the building 12.

Figure 6:
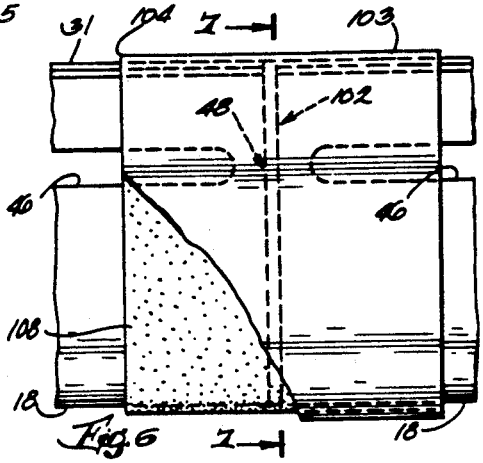
FIG. 6 is an elevational rear view, partially broken away for illustration, of a portion of the rain gutter assembly illustrated in FIG. 1.
Figure 10:
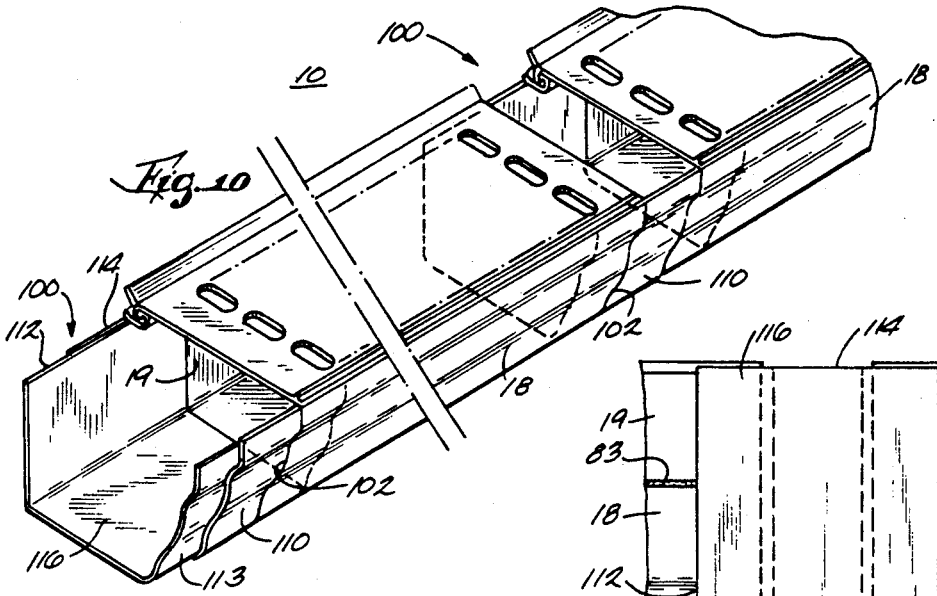
FIG. 10 is a perspective view of an alternative construction for a rain gutter assembly embodying various features of the invention.

As shown in FIGS. 1 and 6, a plurality of slots 46 extend generally horizontally, or longitudinally of the gutter 18, through the rear wall 20 along a portion of the length of the gutter 18. The slots 46 are mutually, longitudinally aligned and each slot 46 extends along the upper portion of the rear wall 20 so that water collected in the rain gutter 18 must accumulate to nearly fill the trough before spilling through the slots 46. Portions of the rear wall 48 extend vertically to define the ends 49 of the slots 46 and to provide support for the rain gutter 18.

Each rain gutter 18 also includes an elongated, generally rigid trough portion 50 having a bottom wall 52 and a front wall 54. The bottom wall 52 is generally horizontal and has a rear edge 56 connected to the lower edge 24 of the rear wall 20 in a manner described below. The front wall 54 extends generally perpendicular to, and integrally from, the bottom wall 52 and has an upper edge 58. With the rear wall 20, the trough portion 50 gives the inner surface 19 of the rain gutter 18 the trough-like cross-sectional configuration and provides the gutter with an outer surface 59.

Each rain gutter 18 also includes a leaf guard 60 having a front edge 64, a rear edge 66 and a web 68 extending between the front edge 64 and the rear edge 66. The front edge 64 is connected to the upper edge 38 of the front wall 54 in a manner described below. The leaf guard 60 extends over the trough between the upper edge 58 of the front wall 54 and the upper edge 22 of the rear wall 20. The web 68 (See FIG. 1) has therein a plurality of holes 70 which are sufficiently large to allow water to fall from the roof 16 and into the rain gutter 18, but which are sufficiently small to prevent leaves, twigs and other material from falling into the rain gutter 18 and obstructing the flow of collected water. The leaf guard 60 has a front lip 72 which, for reasons explained below, extends upwardly from the web 68 along the length of the rain gutter 18 and adjacent the front edge 64 of the leaf guard 60.

The leaf guard 60 supports a flexible drip edge 74 which prevents water from falling from the roof 16 behind the rain gutter 18 and between the side of the building 12 and the rear wall 20. The drip edge 74 (FIG. 2) is preferably integrally formed with the leaf guard 60, extends upwardly from the rear edge 66 of the leaf guard 60 toward the side of the building 12, and contacts the side of the building 12 so that water which falls from the eave 14 falls onto either the drip edge 74 or onto the leaf guard 60. A similar, suitable construction for the drip edge 74 is illustrated in U.S. Pat. No. 4,553,356 which issued to Pepper on Nov. 19, 1985.

The rear edge 66 of the leaf guard 60 terminates in the form of a second clasp member 76 which curls under the web 68. The second clasp member 76 has an end 78 which turns 180° away from the side of the building 12 so that it forms a hook 80 opening toward the front wall 54. The clasp member 76 interlocks with the clasp member 30 in a manner described below.

Each rain gutter 18 also includes means 82 including a first living hinge 83 for integrally and flexibly connecting the rear wall 20 and the trough portion 50. In the preferred embodiment, the means 82 for connecting the rear wall 20 and the trough portion 50 includes a living or integral hinge 83 which extends between the lower edge 24 of the rear wall 20 and the rear edge 56 of the trough portion 50. The living hinge 83 is a thin-walled segment which extends between the rear wall 20 and the trough portion 50 and which is integrally formed therewith.

Each rain gutter 18 also includes means 84 including a second living hinge 85 for integrally and flexibly connecting the front wall 54 and the leaf guard 60. Preferably, the second living or integral hinge 85 extends substantially the entire length of the rain gutter 18 and joins the upper edge 58 of the front wall 54 and the front edge 64 of the leaf guard 60.

The first and second living hinges 83, 85 integrally join the rear wall 20, trough portion 50 and leaf guard 60 as a single unit. The rain gutter 18 can therefore be made by extrusion of plastic, such as polyvinyl chloride, in a single operation. The slots 46 and holes 70 can be punched out of the rear wall 20 and leaf guard 60 respectively after extrusion of the rain gutter 18. No additional parts, such as hinge pins or plates are necessary to form or assemble the rain gutter 18. As shown in FIG. 3, the provision of a rain gutter having hinged components allows the rain gutter 18 to be laid open into a relatively flat position, which facilitates the stacking of the rain gutters.

Figure 4:
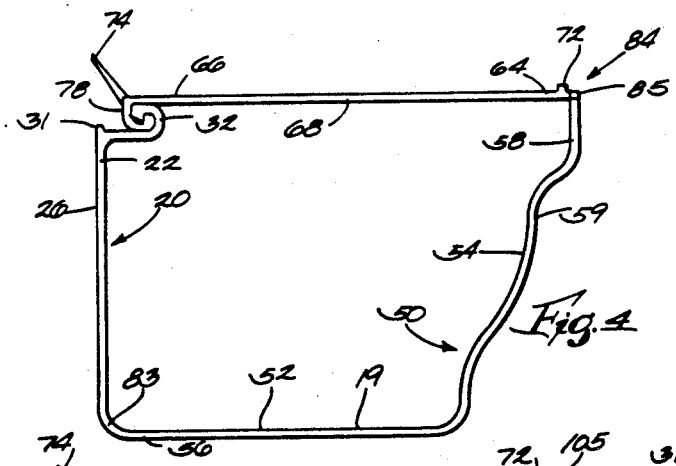
FIG. 4 is an end view of the rain gutter illustrated in FIG. 3 in a closed position.
Figure 5:
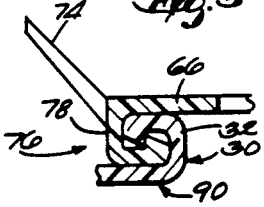
FIG. 5 is an enlarged view of a portion of the assembly illustrated in FIG. 2.

Each rain gutter 18 also includes interlocking means 90 to hold the rain gutter in a trough-like position. Preferably, the interlocking means 90 includes the above-mentioned first and second clasp members 30, 76. The first and second second clasp members 30, 76 are adapted to interlock (FIG. 5) and cooperate to hold the leaf guard 60 in position over the trough formed by walls 20, 52 and 54, and also to hold the rain gutter 18 in a trough-like configuration (FIG. 4).

The rain gutter assembly 10 also includes (FIG. 2) means 91 for supporting the rain gutter 18 on the side of a building 12 to afford relative movement between the rain gutter 18 and the building 12 due to expansion and contraction of the rain gutter. The means 91 for supporting the rain gutter 18 includes the above-described plurality of elongated slots 46 in the rear wall 20, and a plurality of grommets 92. As best shown in FIGS. 8 and 9, each grommet 92 includes a generally oval, cup-shaped portion 93 having an outer wall 94 and a flat, annular wall 95 which faces the inner surface 28 of the rear wall 20. Each grommet 92 also includes a second portion 96 extending rearwardly from the cup portion 93 and into one of the slots 46. The second portion 96 is generally cylindrical and has a length (left-to-right dimension in FIG. 9) greater than the thickness (left-to-right dimension in FIG. 9) of the rear wall 20, so that the second portion 96 extends rearwardly of the surface 26 when the wall 95 of the grommet 92 engages the surfaces 28 of the wall 20. Each grommet 92 has therethrough a bore 97 and is adapted to house a fastener 98, such as a nail or screw. It is contemplated that the fastener 98 will have a head 99 which can be housed in the cup portion 93 of the grommet 92. In the case of a nail, for example, the preferred grommet 92 has a cup portion 93 sufficiently large to house the head of the nail so that the cup portion 93 will absorb the impact of the hammer used to insert the nail 98 into the side of the building 12, and will thereby protect the relatively soft rear wall 20. The grommet 92 is thus constructed to loosely capture the rear wall 20 of the gutter 18 to support the gutter 18 on the building 12, and to afford relative movement between the gutter 18 and the building 12 due to expansion and contraction.

The rain gutter assembly 10 also includes connecting means 100 extending between each pair of mutually aligned, closely-spaced rain gutters 18. The connecting means 100 forms (FIG. 6) a sealed joint 102 between adjacent rain gutters 18 to allow water to channel from one rain gutter to the next, but also to afford relative movement between the pair of rain gutters 18 due to expansion and contraction of the rain gutters 18. Because of the expansion and contraction of the plastic used to make the rain gutters 18, it is preferable that the ends of a pair of rain gutters 18 be closely spaced but not in abutting contact, so as to form a joint 102, when assembled. Preferably, the ends of the rain gutters 18 are spaced approximately an inch apart. Provision of sufficient clearance in the joint 102 between the ends of the rain gutters 18 allows the rain gutters 18 to expand without buckling at the joint 102. In one embodiment illustrated in FIG. 7, the connecting means 100 includes a clip member 103 having a first end 104 which engages the upper lip 31 on the rear wall 20 of each respective rain gutter 18, and a second end 105 which engages the front lip 72 on the the leaf guard 60 of each respective rain gutter 18. The clip member 100 also includes a portion 106 which extends between the first end 102 and second end 104 and which is adapted to wrap around the outer surface of a portion of each respective rain gutter 18.

Figure 7:
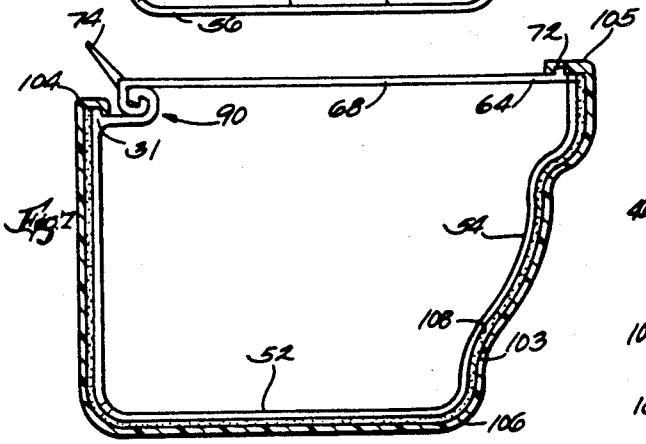
FIG. 7 is a cross-sectional view, taken along line 7—7, of the portion of the assembly illustrated in FIG. 6.

In order to assure a sealed joint between adjacent rain gutters, in the embodiment illustrated in FIGS. 1, 6 and 7 the connecting means 100 also includes a cellular foam gasket 108 which is squeezed between the clip member 103 and the outer surfaces of the closely-spaced rain gutters 18. Provision of the gasket 108 assures that water will flow from one rain gutter to an adjoining rain gutter without leaking out of the joint 102 therebetween. In the illustrated embodiment, an adhesive sealant is applied to the foam gasket 108 on either or both of the inner and outer surfaces of the foam gasket 108, so that the gasket 108 adheres to the clip member 103 and/or to the outer surfaces of the rain gutters 18.

Installation of the rain gutter assembly 10 is simplified by the relatively light weight of the rain gutter 18 and the relatively few number of parts. The rain gutters 18 can be hung in a laid-open position below an eave 14 by positioning the rear wall 20 where desired and fastening the rain gutter 18 and grommets 92 to the side of a building 12. Once hung on the building 12, the rain gutter 18 can be folded into a trough-like position and held in position by interlocking the clasp members 30, 76. Sealing connection of abutting rain gutters 18 is accomplished by placing the adhesive foam gasket 108 over the outer surface of the adjoining gutters 18 and squeezing the gasket 108 against the outer surface of the rain gutters 18 by placing the clip member 103 over the gasket 108 and snapping the ends 104, 105 of the clip member 103 over the front and rear lips 72, 31.

Figure 11:
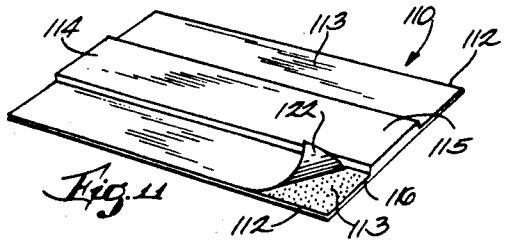
FIG. 11 is a perspective view of an expansion connector.
Figure 13:
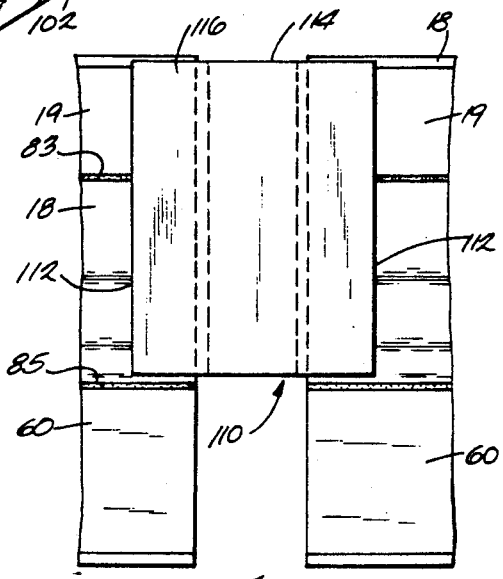
FIG. 13 is a top plan view of a portion of the rain gutter assembly illustrated in FIG. 10 in an unfolded position.
Figure 12:
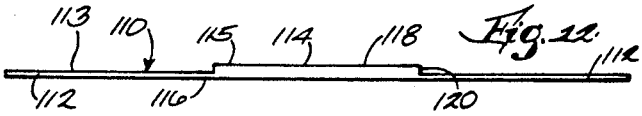
FIG. 12 is an end view of the expansion connector shown in FIG. 11.
Figure 14:
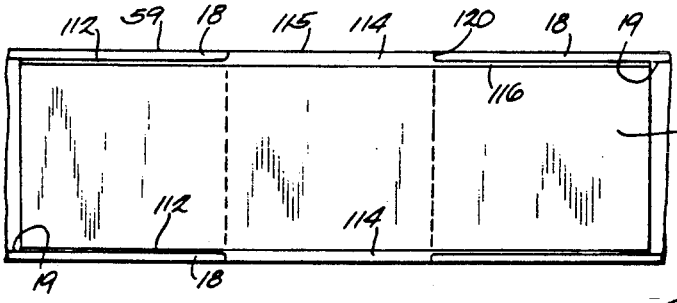
FIG. 14 is a top plan view of the portion illustrated in FIG. 13 and in a folded position.

FIGS. 10–14 illustrate a rain gutter assembly 10 including an alternative construction for the connecting means 100. In the embodiment illustrated in FIGS. 10–14, the connecting means 100 includes an expansion connector 110 which occupies the joint 102 between the pair of aligned and closely spaced rain gutters 18 and which affords relative movement between the rain gutters 18 due to expansion and contraction of the rain gutters 18. The expansion connector 110 is generally flexible and extends between the inner surfaces 19 of the pair of rain gutters 18. The expansion connector 110 is preferably made of a flexible vinyl or a flexible thermoplastic rubber which provides a generally flexible, pliable connector. The connector 110 includes (FIG. 11) a pair of relatively thin side portions 112 each having an exterior surface 113, and a relatively thick central portion 114 which has an exterior surface 115 and which is located intermediate the side portions 112. As shown in FIG. 11, each of the exterior surfaces 113 of the side portions 112 has thereon an adhesive which is covered by a strip 122 of removable paper. As discussed below, the strips 122 can be peeled away from the surfaces 113 prior to fastening the connector 110 to the gutter 18 in order to expose the adhesive. The outer surfaces 113 of the side portions 112 and the outer surface 115 of the central portion 114 constitute an exterior surface 118 of the connector 110. The connector 110 also has (FIG. 12) an interior surface 116 which, as described below, faces opposite the exterior surface 118.

When the connector 110 is laid flat, the interior surface 116 is also generally flat. Because of the relative thickness of the central portion 114, however, the exterior surface 118 of the connector has a step 120 between each of the outer surfaces 113 of the side portions 112 and the outer surface 115 of the central portion 114. Preferably, each step 120 has a height which is approximately equal to the thickness of the walls of the rain gutters 18 so that, as described below, when the connector 110 is assembled with the rain gutters 18, the outer surface 115 of the central portion 114 is substantially flush with the outer surfaces 59 of the rain gutters 18.

In order to assemble the rain gutter assembly 10 using the expansion connectors 110, the rain gutters 18 are (see FIG. 13) laid open in an unfolded position. The gutters 18 are then mounted to the side of a building in the manner described above so that the gutters 18 are aligned in closely-spaced, end-to-end relation. The strips 122 of paper are then removed from the exterior surfaces 113 of the side portions 112 to expose the adhesive thereon. The side portions 112 of the connector 110 are then fastened to the inner surfaces 19 of the respective gutters 18 so that the central portion 114 of the connector 110 extends between the ends of the gutters 18 to form the joint 102 and so that the ends of the rain gutters 18 abut the steps 120 between the side portions 112 and the central portion 114 of the connector 110. The connector 110 extends from adjacent the upper edge of the front wall to adjacent the upper edge of the rear wall of each of the gutters.

Once the side portions 112 are properly fastened to the inner surfaces 19 of the respective rain gutters 18, the rain gutter assembly 10 then can be folded (FIGS. 10 and 14) into a trough-like configuration in the above-described manner.

Once gutters 18 and the connector 110 are assembled, the expandable connector 110 affords relative movement between the rain gutters 18. The connector 110 allows expansion and contraction of the rain gutters 18 by expansion and contraction of the central portion 114 of the connector 110. The adhesive between the connector 110 and the inner surfaces 19 of the gutters 18 provides a substantially water-tight joint.

Figure 16:
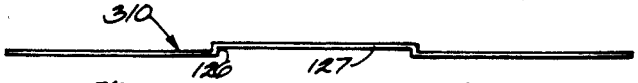
FIG. 16 is an end view similar to FIG. 12 of an alternative construction of an expansion connector.

FIGS. 15–18 illustrate alternative constructions of the expansion connector 110. The connector 210 illustrated in FIG. 15 includes a central portion 114 having therein a cavity 124 which extends in a direction generally perpendicular to the length of the gutter 18. FIG. 16 illustrates a connector 310 which includes a channel 126 in the interior surface 116, which channel 126 extends in a direction generally perpendicular to the length of the gutters 18. The channel is defined by an inner surface 127 extending generally parallel to the exterior surface 115 of the central portion 114.

Figure 17:
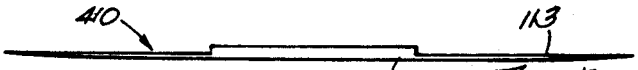
FIG. 17 is an end view similar to FIG. 12 of an alternative construction of an expansion connector.
Figure 15:
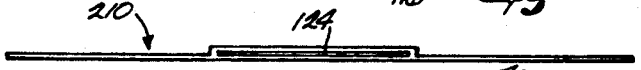
FIG. 15 is an end view similar to FIG. 12 of an alternative construction of an expansion connector.

In the embodiment illustrated in FIG. 17, the interior surface 116 of the connector 410 has feathered edges which curve or slope toward the interior surfaces 19 of the gutters 18. Because, when the connector 110 is fastened to the interior surfaces 19 of the rain gutters 18, the interior surface 116 of the connector 110 faces inwardly of the rain gutters 18, water which is channeled along the rain gutters travels over the interior surface 116. The provision of feathered edges on the interior surface 116 of the connector 110 smooths the transition between the inner surfaces 19 of the gutters 18 and the inner surface 116 of the connector 110 and reduces the probability of the gutter assembly 10 becoming clogged.

Figure 19:
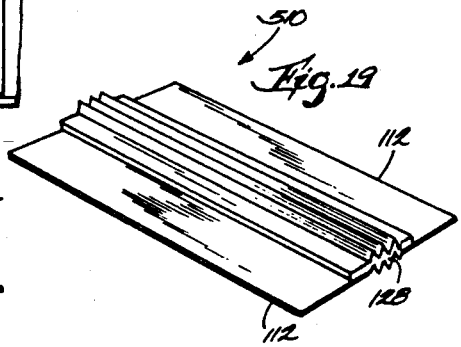
FIG. 19 is a perspective view of the expansion connector illustrated in FIG. 18.
Figure 18:
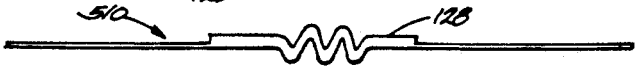
FIG. 18 is an end view similar to FIG. 12 of an alternative construction of an expansion connector.

The connector 510 illustrated in FIGS. 18 and 19 includes a bellows portion 128 having an accordian-like, foldable wall which extends between the side portions 112 of the connector 510.

Each of the constructions for the expandable connector illustrated by FIGS. 10–19 provides a central portion which can be compressed or stretched to accommodate relative movement between the rain gutters 18 and which can wrap around the trough-like interior surfaces 19 of the gutters 18.

Various features are set forth in the following claims:

1. A one-piece, extruded rain gutter comprising
a rear wall having a length,
a trough portion having a length,
a leaf guard having a length,
means including a first living hinge extending substantially the entire length of said rear wall and said trough portion for flexibly and integrally connecting said rear wall and said trough portion, and
means including a second living hinge extending substantially the entire length of said trough portion and said leaf guard for flexibly and integrally connecting said trough portion and said leaf guard,
said hinges allowing said gutter to be laid open in a substantially flat position so as to be easily stacked for storage and handling.

2. A rain gutter as set forth in claim 1 and further including means for supporting said rain gutter on a building.

3. A rain gutter as set forth in claim 2 wherein said rear wall has an inner surface facing said trough portion an outer mounting surface facing the building and a thickness between said inner and outer surfaces, and wherein said means for supporting said rain gutter includes, in said rear wall, at least one elongated slot extending along a portion of the length of said rear wall, and a grommet having a first portion facing said inner surface of said rear wall, having a second portion extending into said slot, said second portion having a length greater than said thickness, and having therethrough a bore adapted to house a fastener.

4. A rain gutter as set forth in claim 1 wherein said leaf guard has a front edge, wherein said rear wall has a lower edge, wherein said trough portion includes a bottom wall having a rear edge and a front edge, and a front wall having a lower edge connected to said front edge of said bottom wall, and having an upper edge, wherein said first hinge connects said lower edge of said rear wall and said rear edge of said bottom wall, and wherein said second hinge connects said upper edge of said front wall and said front edge of said leaf guard.

5. A rain gutter assembly for collecting water for the roof of a building, said assembly comprising
an elongated rain gutter including a rear wall having an inner surface, an outer mounting surface and a thickness between said inner and outer surfaces, said rain gutter including a trough portion, a leaf guard, a first elongated hinge extending substantially the entire length of said rain gutter and flexibly and integrally connecting said rear wall and said trough portion and a second hinge extending substantially the entire length of said rain gutter and flexibly and integrally connecting said trough portion and said leaf guard, and means for supporting said rain gutter on the building to afford relative movement between said rain gutter and the building due to expansion and contraction of said rain gutter, said means for supporting said rain gutter including, in said rear wall, at least one elongated slot extending along a portion of the length of said rain gutter, and a grommet having a first portion facing said inner surface of said rear wall, having a second portion extending into said slot, said second portion having a length greater than said thickness, and having therethrough a bore adapted to house a fastener.

6. A rain gutter assembly as set forth in claim 5 and further including a fastener extending through said bore and into the building.

7. A rain gutter assembly comprising a pair of rain gutters having respective inner and outer surfaces and having respective ends, said pair of rain gutters being aligned and said ends begin closely spaced, means of supporting said pair of rain gutters on a building for collecting water, and means extending between and connecting said ends of said pair of rain gutters for affording relative movement between said pair of rain gutters, said connecting means including a flexible connector having a pair of side portions, each of said side portions having an exterior surface fastened to said inner surface of a respective one of said rain gutters, said connector having a central portion located intermediate said side portions, said central portion extending been said ends of said rain gutters and extending outwardly of said inner surfaces of said rain gutters, said central portion having an outer surface which is substantially flush with said outer surfaces of said rain gutters, and said connector expanding in response to contraction of said gutters and contracting in response to expansion of said gutters.

8. A rain gutter assembly as set forth in claim 7 wherein each of said rain gutters includes a trough-like inner surface, ad wherein said connector extends from said front wall to said rear wall and sealingly engages said inner surface.

9. A rain gutter assembly as set forth in claim 8 wherein each of said gutters includes a front wall having an upper edge, and a rear wall having an upper edge, and wherein said connector extends from adjacent said upper edge of said front wall to adjacent said upper edge of said rear wall.

10. A rain gutter assembly as st forth in claim wherein said connector has an interior surface facing inwardly of said rain gutters, and wherein said interior surface has therein a channel which extends generally perpendicular to the length of said gutters.

11. A rain gutter assembly as set forth in claim 7 wherein said central portion includes a bellows portion extending between said side portions.

12. A rain gutter assembly as set forth in claim 7 wherein said connector has an interior surface facing inwardly of said rain gutters, said interior surface having edges which slope toward said inner surfaces of said rain gutters.

13. A rain gutter assembly as set forth in claim 7 wherein said central portion has therein a cavity extending generally perpendicular to the length of said gutters.

14. A rain gutter assembly as set forth in claim 7 wherein said central portion is integrally formed with said side portions.

15. A rain gutter assembly comprising a pair of rain gutters having respective ends and inner surfaces, said pair of rain gutters being aligned and said ends being closely spaced and non-overlapping, means for supporting said pair of rain gutters on a building for collecting water, and a flexible connector extending between and sealingly connecting said ends of said pair of gutters for affording relative movement between said pair of gutters, ad flexible connector being the sole structure connecting said ends of said pair of gutters, said connector having an interior surface facing inwardly of said rain gutters, said interior surface having edges which slope toward said inner surfaces of said rain gutters, and said connector expanding in response to contraction of said gutters and contracting in response to expansion of said gutters.

16. A rain gutter assembly comprising a pair of rain gutters having respective inner surfaces and having respective ends, said pair of rain gutters being aligned and said ends being closely spaced, mean for supporting said pair of rain gutters on a building for collecting water, and means extending between and connecting said ends of said pair of rain gutters for affording relative movement between said pair of rain gutters, said connecting means including a flexible connector having a pair of side portions, each of said side portions having an exterior surface fastened to said inner surface of a respective one of said rain gutters, said connector having an interior surface facing inwardly of said rain gutters, said interior surface having edges which slope toward said inner surfaces of said rain gutters, and said connector having a central portion located intermediate said side portions, said central portion extending between said ends of said rain gutters and extending outwardly of said inner surfaces of said rain gutters, and said central portion including a bellows portion extending between said side portions.

17. A rain gutter assembly comprising a pair of rain gutters having respective inner surfaces and having respective ends, said pair of rain gutters being aligned and said ends begin closely spaced, means for supporting sad pair of rain gutters on a building for collecting water, and means extending between and connecting said ends of said pair of rain gutters for affording relative movement between said par of rain gutters, said connecting means including a flexible connector having pair of side portions, each of said side portions having an exterior surface fastened to said dinner surface of a respective one of said rain gutters, said connector having a central portion located intermediate said side portions, said central portion extending between said ends of said rain gutters and extending outwardly of said inner surfaces of said rain gutters, and sad connector having an interior surface facing inwardly of said rain gutters, said interior surface having edges which slope toward said inner surfaces of said rain gutters.

18. A rain gutter assembly comprising a pair of rain gutters having respective inner surfaces and having respective ends, said pair of rain gutters being aligned and said ends being closely spaced, and each of said gutters having an outer surface, and means extending between and connecting said ends of said pair of rain gutters for affording relative movement between said gutters said connecting means including a connector having a pair of side portions, each of said side portions having an exterior surface sealingly engaging said inner surface of a respective one of said rain gutters, said connector also having a central portion located intermediate said side portions, said central portion extending between said ends of said rain gutters and having an outer surface which is substantially flush with said outer surfaces of said rain gutters, said exterior surface of each of said side portions being fastened to the associated gutter inner surface.

19. A rain gutter assembly comprising a pair of rain gutters having respective inner surfaces and having respective ends, said pair of rain gutters being aligned and said ends being closely spaced, and each of said gutters having an outer surface, and means extending between and connecting said ends of said pair of rain gutters for affording relative movement between said gutters, said connecting means including a connector having a pair of side portions, each of said side portions having an exterior surface sealingly engaging said inner surface of a respective one of said rain gutters, said connector also having a central portion located intermediate said side portions, said central portion extending between said ends of said rain gutters and having an outer surface which is substantially flush with said outer surfaces of said rain gutters, said connector being flexible and expanding and contracting in response to contraction and expansion of said gutters.

* * * * *